US005318340A

United States Patent [19]

Henry

[11] Patent Number: 5,318,340

[45] Date of Patent: Jun. 7, 1994

[54] CONFERENCE CENTER

[75] Inventor: Robert R. Henry, Andover, Mass.

[73] Assignee: Yorkshire Industries, Inc., North Andover, Mass.

[21] Appl. No.: 143,371

[22] Filed: Oct. 25, 1993

Related U.S. Application Data

[63] Continuation of Ser. No. 831,411, Feb. 5, 1992, abandoned.

[51] Int. Cl.[5] ..... A47C 15/00

[52] U.S. Cl. ..... 297/232; 297/344.21; 297/217

[58] Field of Search ..... 297/344.21, 344.23, 297/344.1, 248, 232, 217, 452.35, 344, 194, 244, 240, 460; 5/109

[56] References Cited

U.S. PATENT DOCUMENTS

| | | | |
|---|---|---|---|
| 39,265 | 4/1908 | Holtzclaw | 297/244 X |
| 1,228,434 | 6/1917 | Hedberg | 297/344.23 X |
| 1,937,578 | 12/1933 | Knight | 297/349 X |
| 2,849,729 | 9/1958 | Goodey, Jr. et al. | 297/217 X |
| 3,191,594 | 6/1965 | Bagnell | 297/344.23 X |
| 3,394,964 | 7/1968 | Humphries et al. | 297/240 |
| 4,064,376 | 12/1977 | Yamada | 297/217 X |
| 4,072,346 | 2/1978 | Schueler | 297/217 |
| 4,584,603 | 4/1986 | Harrison | 297/217 X |
| 4,662,679 | 5/1987 | Franck et al. | 297/349 X |
| 4,758,047 | 7/1988 | Hennington | 297/217 X |
| 4,826,245 | 5/1989 | Entratter | 297/217 |
| 4,868,888 | 9/1989 | Dayton | 297/194 X |
| 4,969,685 | 11/1990 | Chihaya et al. | 297/344.23 |
| 4,979,777 | 12/1990 | Takada | 297/217 X |
| 5,083,838 | 1/1992 | Maxwell, Jr. | 297/232 X |

FOREIGN PATENT DOCUMENTS

| | | | |
|---|---|---|---|
| 0214951 | 3/1987 | European Pat. Off. | 297/217 |
| 2449193 | 4/1976 | Fed. Rep. of Germany | 297/217 |
| 3331946 | 5/1984 | Fed. Rep. of Germany | 297/217 |

*Primary Examiner*—Kenneth J. Dorner
*Assistant Examiner*—Milton Nelson, Jr.
*Attorney, Agent, or Firm*—Fish & Richardson

[57] ABSTRACT

A conference center is provided which includes a circular or polygonal arrangement of seating elements having a center. Each seating element faces outward from the center, and a device is provided for rotating the arrangement about a vertical axis through its center. This conference center provides a setting for group meetings which eliminates many of the distractions involved in face-to-face meetings.

10 Claims, 4 Drawing Sheets

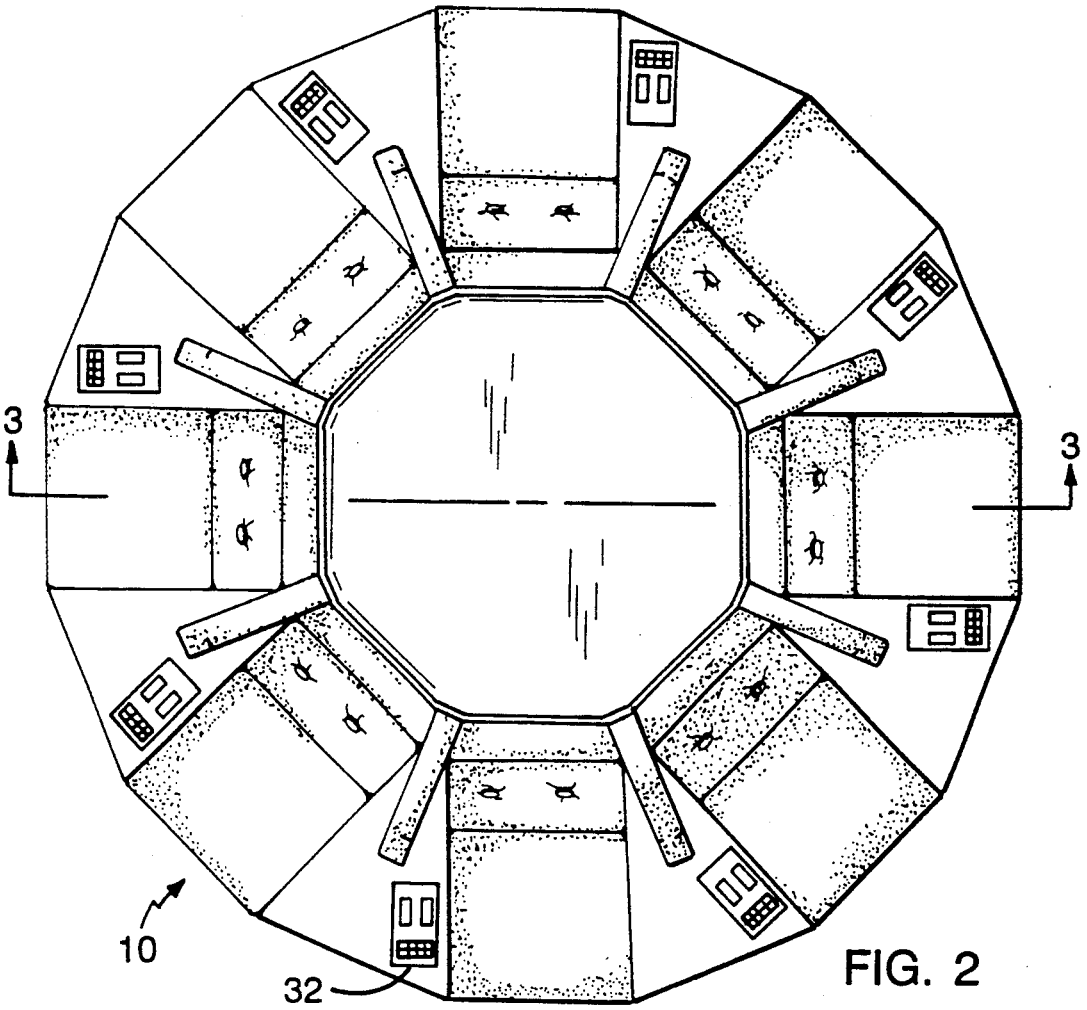
FIG. 2
FIG. 3
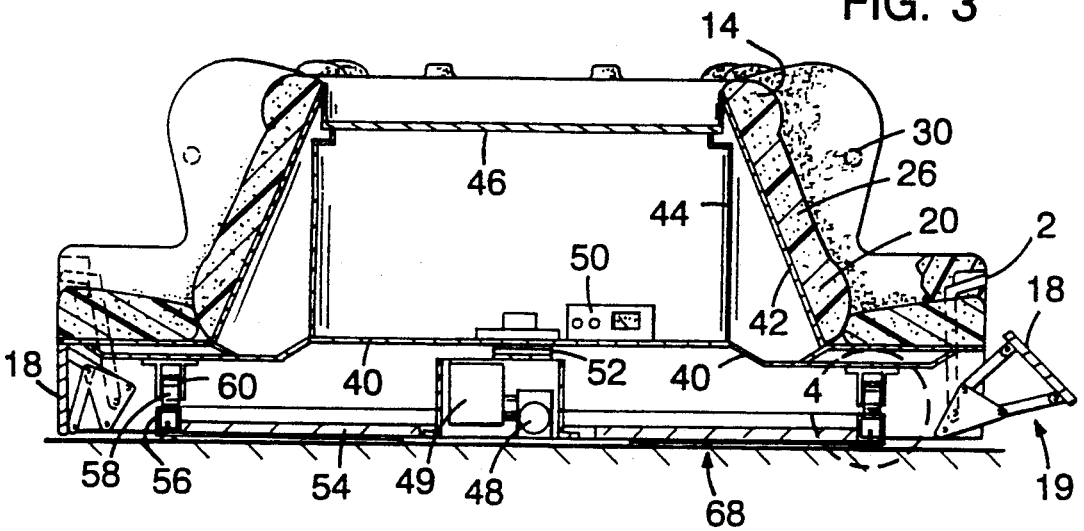

CONFERENCE CENTER

This is a continuation of application Ser. No. 07/831,411, filed Feb. 5, 1992, now abandoned.

BACKGROUND OF THE INVENTION

The present invention relates to a conference center which seats a plurality of persons, providing a setting for meetings and other similar gatherings.

Many situations occur in the workplace, as well as other settings, in which a group of persons gather to discuss a given topic. The gathering may take the form of a business meeting, brainstorming session, educational class, or group therapy session.

While it is advantageous to meet in person for such purposes, these gatherings frequently are unproductive, and may break down into hostility or, conversely, casual conversation. One explanation for this problem is the visual distraction caused by the different physical appearances, clothing, mannerisms and the like of the participants. Similarly, participants may expend unproductive energy in attempting to analyze the expressions and "body language" of their fellow participants. These problems are often exacerbated by the typical setting for gatherings, in which participants face each other across a conference table, which tends to promote a confrontational atmosphere.

One alternative to face-to-face meetings is the use of "conference calls" to enable a number of persons to converse simultaneously over the telephone. While these calls eliminate some of the distractions inherent in a face-to-face meeting, they are fraught with other office distractions, e.g. intrusion by persons not involved in the call.

Another alternative to face-to-face meetings is electronic meetings, which have recently been introduced into the workplace. These meetings allow all participants to converse simultaneously via telecommunications, through the use of computers. While electronic meetings may eliminate the excessive conversation and visual distractions involved in face-to-face meetings, this approach hinders creativity by requiring the participants to type out all of their thoughts, limiting the free flow of ideas to the typing speed of the individuals. This approach also is subject to distractions similar to those involved with conference calls. This approach also may not be suitable for applications such as group education and therapy in the health care field, which may involve sensitive subject matter and require confidential treatment.

Thus, it is desired to provide in the workplace, and other settings which involve group meetings, an alternative setting for face-to-face meetings which would improve their productivity and usefulness.

SUMMARY OF THE INVENTION

The present invention provides a novel setting for group meetings, which is designed to eliminate the distractions involved in many face-to-face meetings, while maintaining a pleasant atmosphere and allowing for personal interaction between the meeting participants.

This setting, the conference center of the invention, comprises a plurality of seating elements arranged in a circular or polygonal arrangement about a vertical central axis, each seating element facing outward from said central axis, and a means for rotating said arrangement about said axis. When using the conference center, meeting participants are seated facing outward, preferably with no visual contact with their neighboring participants, thus minimizing visual distractions and promoting a non-confrontational atmosphere. The conference center rotates to distract the participants from personal awareness of each other and provide a changing view. In this manner, repeated use of the Center by the same participants will not produce problems, e.g. participants continually facing the same art work on the wall.

In a preferred embodiment of the invention, the conference center is provided with an audio system, preferably comprising two speakers, disposed in the headrest of each seat, a microphone which clips onto the front of a jacket or blouse, and is plugged into the seating element through a standard audio jack, and a means for controlling the volume from the speaker. It is further preferred that the audio system include a means for identifying the participants to a person later transcribing the minutes of the meeting, e.g. a visual indicator, such as an LED display, which will indicate which channel each voice is coming from, and a means for recording a meeting held in the conference center, e.g. a conventional tape recording apparatus.

It is also preferred that the conference center be provided with ergonomic seating, preferably including a lumbar support and an inclined leg rest; a means for voting, disposed in each seating element, and a means for tallying votes cast by the participants; and a means for leveling the conference center when it is to be utilized on an uneven surface. While the conference center may have any desired number of seating elements, it is preferred that the center comprise at least five elements, and more preferably eight.

It is further preferred that the conference center be provided with a rotation means, to allow the center to rotate at a controlled speed when in use. This rotation means preferably comprises a circular track secured to a surface on which the conference center is disposed by a means adapted to allow the track to be vertically adjusted such that it is substantially level, a plurality of wheels rotatably attached to the lowermost surface of the center, each wheel positioned such that it rides upon said track when the center is rotated, and a motor for rotating the center.

For durability, it is preferred that the center comprise a rigid frame which maintains the seating elements in the circular or polygonal arrangement. Preferably, the seating elements are removably attached to the frame, so they may be removed to facilitate transportation of the center and to allow it to fit through a standard doorway.

The conference center is advantageous for many types of meetings, for example, confidential and/or sensitive areas, e.g. psychological or psychiatric counseling or labor negotiations; mediation sessions; stress management; and business meetings involving mixed disciplines.

BRIEF DESCRIPTION OF THE DRAWINGS

FIG. 2 is a top plan view of the conference center shown in FIG. 1.

FIG. 3 is a cross-sectional view of the conference center shown in FIGS. 1 and 2, taken along line 3—3 in FIG. 2.

DETAILED DESCRIPTION

A conference center 10, according to a preferred embodiment of the invention, is shown in the accompanying drawings. In this embodiment, the center comprises eight seating elements 12. While the conference center of the invention may comprise any desired number of seating elements, it is preferred that the center comprises at least five elements, and more preferably eight elements.

Figure 1:
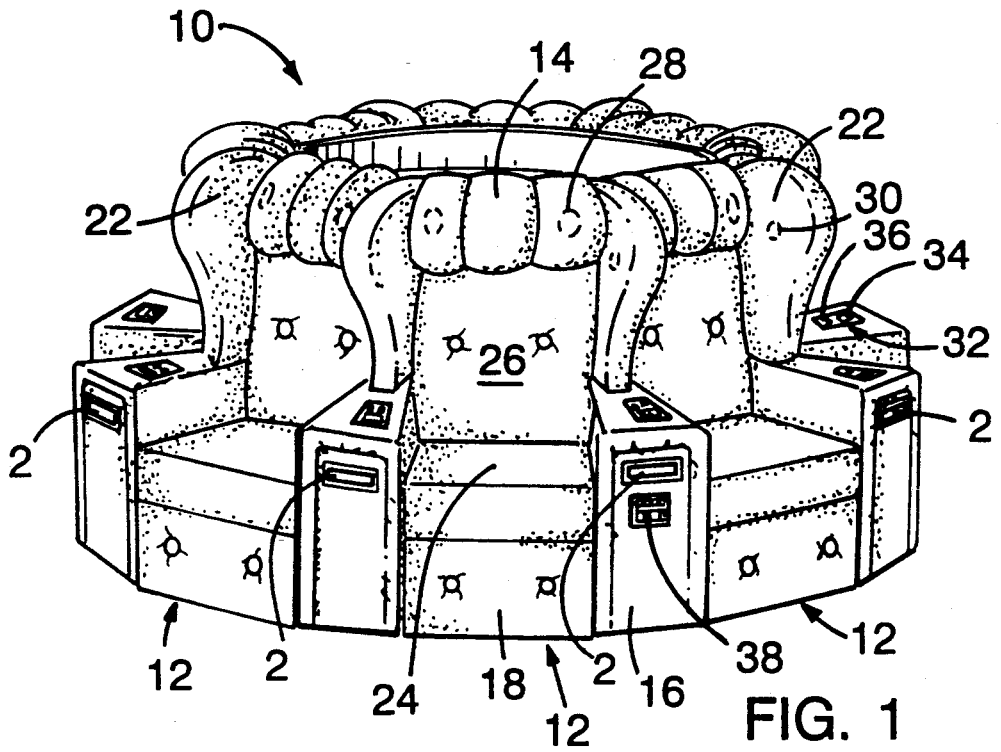
FIG. 1 is an isometric view of a conference center according to one embodiment of the invention.

As shown in FIG. 1, each seating element preferably comprises a headrest 14, back 26, seat 24, and leg rest 18. Each seating element shares with the adjacent two elements a wing or divider 22, on each side of back 26, designed to acoustically and visually isolate neighboring attendees, and an armrest 16 disposed below each divider. It is also preferred that back 26 include a lumbar support 20 (see FIG. 3). This lumbar support may be a bulge which is integral with the back, as shown in FIG. 3, or a separate cushion or support (not shown). When a separate support is provided, this support may be adjustable to various positions, either manually or by an electro-mechanical adjustment means. Preferably, leg rest 18 is adjustable to an inclined position, as shown in FIG. 3, e.g. by forward actuation of linkage 19. This adjustment may be made manually by lever 2 (see FIG. 1), or by the provision of electronic adjustment means (not shown), both of which are known in the art.

Figure 4:
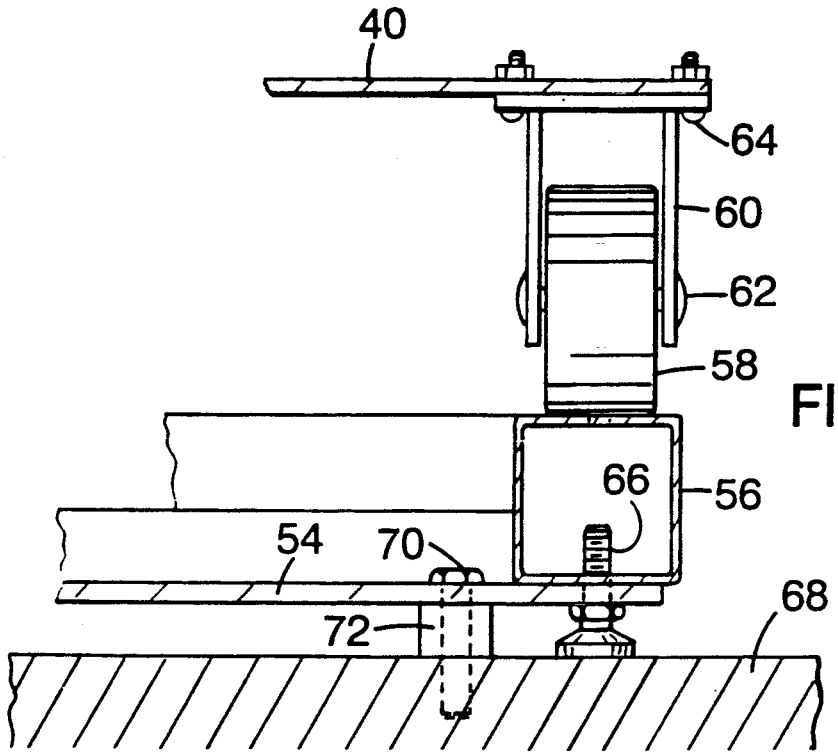
FIG. 4 is an enlarged view of detail 4 in FIG. 3.

As shown in FIGS. 3 and 4, the individual seating elements are maintained in the desired arrangement by base 40, polygonal frame member 44, polygonal seat support 42 and upper horizontal support 46, which together provide a rigid frame. This frame supports seating elements 12 in their circular or polygonal arrangement. The seating elements may be permanently attached to the frame, for durability of the assembly, or may be detachable for easy cleaning, replacement and transportation. The frame may also be adapted such that it could be expanded to allow for the addition of seating elements.

To facilitate communication between the outward-facing meeting participants, it is preferred that each seating element include an audio system, comprising a speaker, a microphone and a volume control. Such a system is shown in FIG. 1, in which microphone 30 is disposed in divider 22 and speaker 28 is disposed in the back 26 of the seating element, at approximately ear level. Alternatively, the microphone may be a conventional LAVALIER microphone, i.e. a microphone that clips on to the user's clothing or loops around the user's neck and is plugged into a microphone jack in the control panel, and/or the speaker may be disposed in divider 22. Individual headsets may be employed in lieu of the headrest speakers. In such cases, the headset is inserted into an audio jack which enables the headset and turns off the headrest speakers. A volume control 36 is disposed in each control panel 32 and connected to a central electronic controller. A connector for optional headphone use is also preferably provided. Any conventional audio equipment may be utilized. All of the audio devices used preferably terminate in a multipin connector located at the base of each seating element, and are plugged in to a central electronic controller, e.g. the central controller illustrated in FIG. 6, by cables.

For many applications, it is preferred that the audio system also have the capability to record meeting sessions. For this purpose, tape recorder 38 is provided on one surface of the center, allowing a user to input a cassette tape and begin recording at any desired time during the meeting. The tape recorder input is connected to the audio system. Any known tape recording equipment may be used to provide this capability. It is preferred that the recorder be a multi-channel recorder having the capability to automatically reroute input from a failed channel to a spare channel. Suitable recorders, e.g. TEAC recorder models CR-310 or CR-320, are commercially available from TEAC America Inc., Montebello, Calif.

Figure 5:
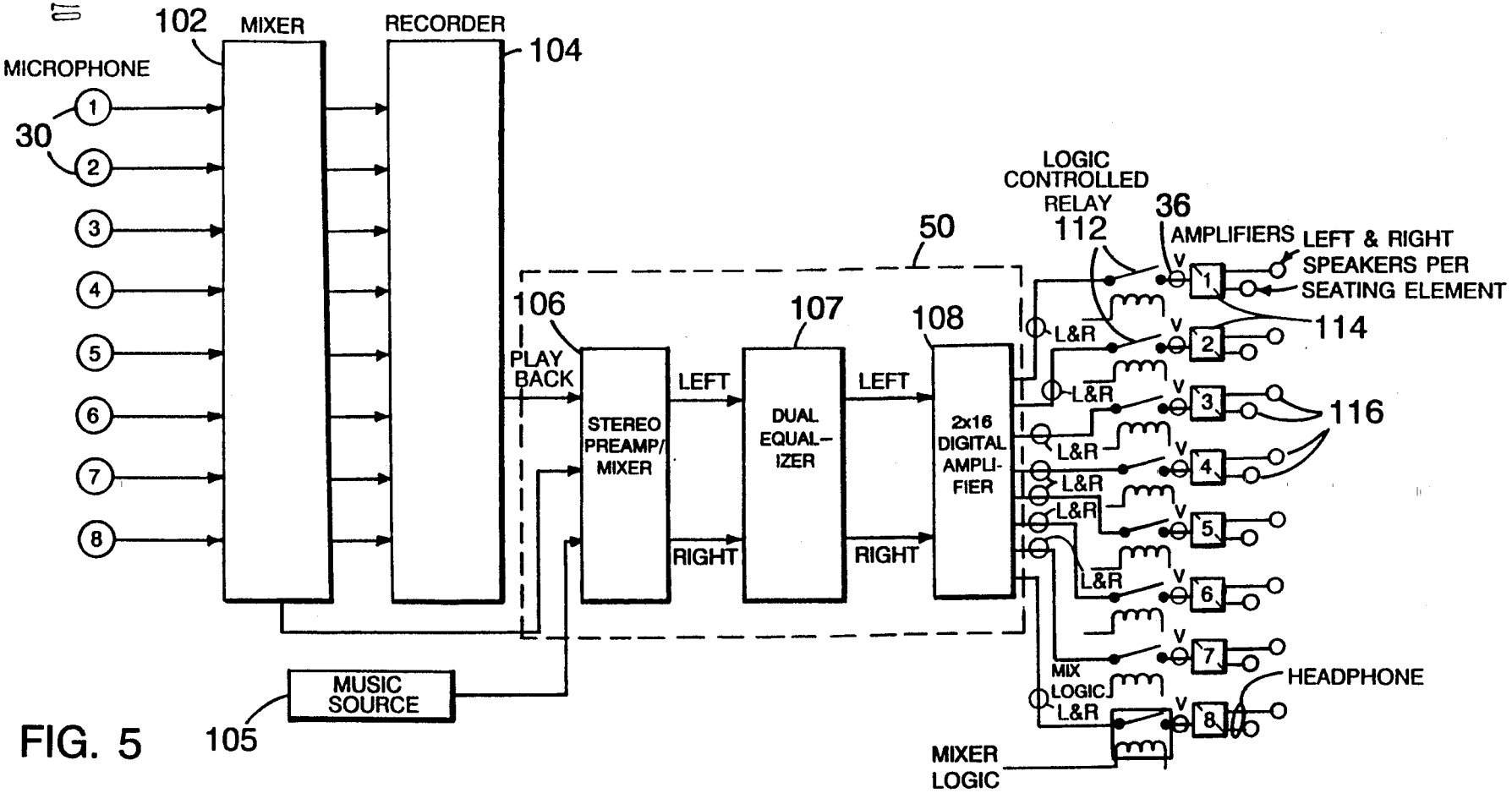
FIG. 5 a schematic diagram showing a preferred audio system.

The audio system preferably further comprises central audio equipment. FIG. 5 illustrates a preferred audio system, suitable for a conference center having eight elements. A microphone 30 is located at each seating element. The input from the eight microphones passes to a controlled single source primary mixer 102, which performs the functions of simultaneously balancing the microphone input signals, turning off microphones which are not active, and providing a direct out for each signal to a recording device 104 (if the recording device is turned on by the participants), a combined signal out to a secondary mixer 106, and individual logic outputs for each channel to activate any desired external devices. If desired, background music may be input to preamp/mixer 106 by music source 105 which may be, e.g. a conventional CD player. A pair of left and right outputs, generated by preamp/mixer 106, is passed to dual equalizer 107, which provides for proper frequency reproduction at each channel, and is then split into eight pairs of left and right outputs by distribution amplifier 108. (Preamp/mixer 106, dual equalizer 107 and distribution amplifier 108 together comprise amplifier 50, shown in FIG. 3.) Logic controlled relay 112 provides a cut-off, so that the participant at each seat will not hear his own voice. (In an alternative embodiment, the system may be configured so that the volume of the participant's own voice is reduced.) Each output pair is then amplified by an amplifier 114, and emitted through left and right speakers 116. Voice level control 36 at each control panel allows each participant to modulate the voices of the other participants to a uniform, pleasant level. Each seating element of the center may also comprise a momentary or mute button (not shown) which will silence that seating element temporarily when the button is depressed. This feature is useful for eliminating distractions such as sneezing and coughing. The preferred audio system illustrated may be assembled using any suitable conventional audio equipment.

Figure 6:
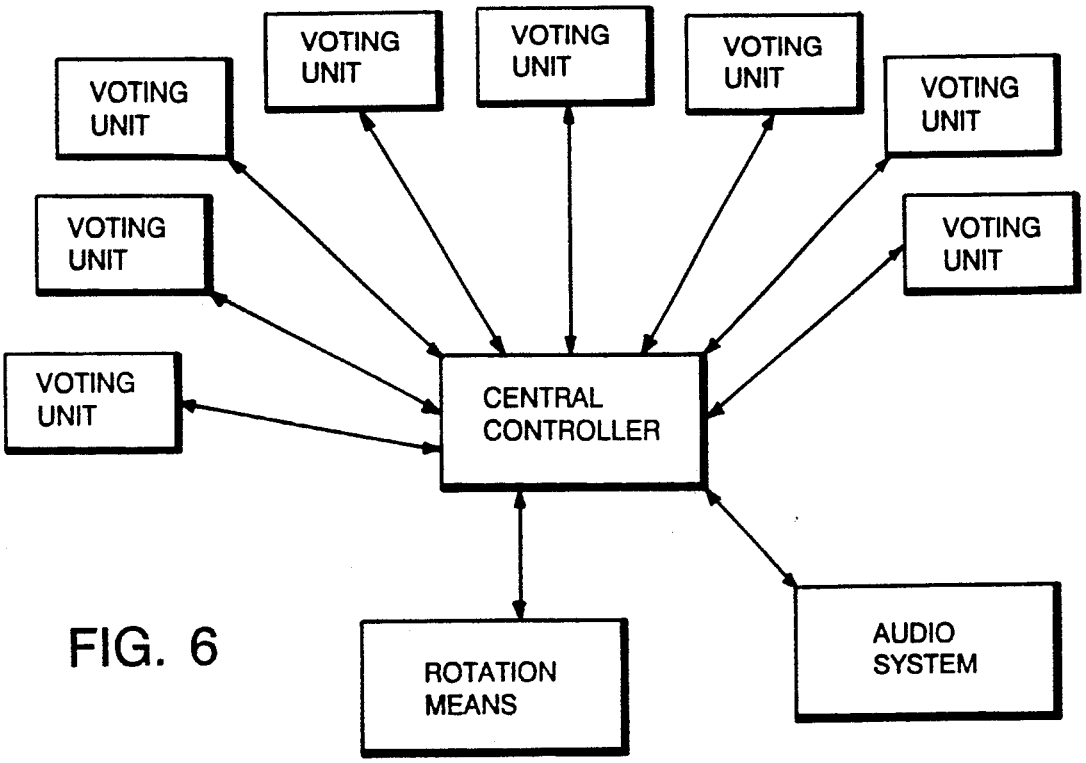
FIG. 6 is a schematic diagram showing a preferred central control system for the conference center.

Also provided on each control panel 32 is a vote switch 34, allowing attendees to cast votes among a selection of choices on questions which may arise during the meeting. This vote switch is connected to a vote tallying means, e.g. a conventional programmable controller such as is shown in FIG. 6, which registers each vote and calculates the number of votes for each possible selection. It is preferred that each seat employ an occupancy sensor for voting purposes which is activated by the insertion of the microphone plug into its corresponding jack, or, if a microphone integral with the seating element is used, by the voice activation of that particular channel by the participant introducing himself to the Center, thereby identifying that particular voice channel for transcription. Preferably, the results of the votes are reported to the attendees, either by a visual display on each control panel or by a message via the speaker, as known in the art, after all the votes have been tallied.

In a preferred embodiment, the voting system allows each participant to vote yes or no, or abstain, by pressing an appropriately marked button on her control panel, and then pressing another button marked, e.g., "cast vote", to send the vote to be tallied. (Until "cast vote" is pressed, the participant may change her vote). A vote is announced by a taped message which overrides the audio system, e.g., "you have 45 seconds to select 'yes', 'no' or 'abstain' and then press 'cast vote'". At the end of the time period allowed for voting, the votes are tallied by the central controller. After the votes have been tallied, the result is displayed by a light on the appropriate button. The result and time of the vote may be recorded by the central controller.

FIG. 6 illustrates a preferred central control system for the conference center. The voting units (one for each seating element), rotation means, and audio system are each independently connected in two-way communication with a central controller. The central controller is preferably a low end programmable logic controller, having 48 low voltage DC inputs and 32 low voltage DC outputs. Suitable controllers are commercially available from ALLEN BRADLEY GOULD FANUC and SQUARE D Companies. The programming of these controllers to perform the functions described above is known and understood by those skilled in the art.

The conference center is provided with a motor for rotating the seating element arrangement, shown schematically in FIG. 3. The illustrated rotation means comprises motor 48, speed reducer 49 disposed between motor 48 and base 40 (connection shown schematically), and slip ring assembly 52 which brings power to the audio system and other systems. The rotation means further comprises circular track 56, and wheels 58, which are rotatably attached to bracket 60 by shaft 62 and ride on track 56 when the motor 48 is activated. It is preferred that the motor be a 1750 rpm, 0.5 hp motor, or similar, and the speed reducer be capable of a 100,000:1 three-stage reduction. Other means known in the art for rotating carrousels and the like could be used, provided the drive mechanism has adequate power to drive the center when all its seats are occupied by attendees, and the speed can be reliably controlled at a safe and comfortable level (approximately one full rotation per hour is preferred).

It is preferred that the center also be provided with a leveling means, to ensure that rotation is smooth. In the embodiment shown in the drawings, this leveling means, shown in detail in FIG. 4, comprises platform 54, which supports track 56, and is adjustably attached thereto by leveling screw 66. Platform 54 is secured in fixed spaced relation to surface 68 by attachment means 70 and spacer 72, and bracket 60 is secured to base 40 of the center by attachment means 64 (bolts are shown, but other conventional means, e.g. screws and the like, may be used). As the center is driven by the rotation means, wheel 58 rides on track 56, which can be adjusted vertically, by rotating leveling screw 66. This leveling adjustment will compensate for irregularities in surface 68 and allow for smooth rotation.

For optimal meeting conditions, it is preferred that the conference center be placed in a windowless, climate controlled room. It is also preferred that the room be large enough that adequate space is left between the conference center and the walls of the room for the attendees comfort, and that the room be sound insulated.

Preferred embodiments of the invention have been illustrated hereinabove. Other modifications and variations may be practiced by those skilled in the art without departing from the scope of the invention.

What is claimed is:

1. A conference center comprising:

a) a plurality of seating elements arranged about a vertical central axis, each seating element facing outward with respect to said central axis;

b) an audio system comprising a microphone and a speaker associated with each of said seating elements, each microphone communicating with said speakers in the other seating elements;

c) a rotatable support structure on which said seating elements are mounted, said support structure being rotatable about said axis; and d) a motor operatively connected to said support structure for rotating said support structure about said axis.

2. The conference center of claim 1 wherein the audio system further comprises a means for identifying a person seated in each seating element.

3. A conference center of claim 1 having at least 5 seating elements.

4. The conference center of claim 1 wherein said seating elements are arranged in a circular arrangement.

5. The conference center of claim 1 wherein said seating elements are arranged in a polygonal arrangement.

6. The conference center of claim 1 wherein each said seating element includes a means for voting disposed on a surface of each said seating element.

7. The conference center of claim 6 wherein each said seating element has an armrest, and each said means for voting is disposed in each said armrest.

8. The conference center of claim 1 in which each seating element comprises a seat having a back and a headrest, and a wing extending outwardly from said back between each adjacent seating element.

9. The conference center of claim 8 wherein a said speaker is disposed in each of said headrests and a said microphone is disposed in one wing of each seating element.

10. The conference center of claim 8 further comprising a recording apparatus connected to said audio system for recording a meeting held in the conference center.

* * * * *

UNITED STATES PATENT AND TRADEMARK OFFICE

CERTIFICATE OF CORRECTION

PATENT NO. : 5,318,340

DATED : Jun. 7, 1994

INVENTOR(S) : Henry

It is certified that error appears in the above-identified patent and that said Letters Patent is hereby corrected as shown below:

On the title page, item [56]:

In the References Cited section, U.S. Patent Documents, please add the following:

| Patent No. | Inventor | Date of Publication |
|---|---|---|
| D-206,658 | Raiford | 1/10/67 |
| 720,692 | Hawkins | 2/17/03 |
| 1,912,576 | Gazarian | 6/6/33 |
| 2,646,281 | Hurst | 7/21/53 |
| 2,908,766 | Taylor | 10/13/59 |
| 3,002,787 | Ziegenfuss | 10/3/61 |
| 3,156,500 | Kerr | 11/10/64 |
| 3,511,498 | Ahrens | 5/12/70 |
| 3,630,566 | Berecki | 12/28/71 |
| 4,776,635 | Halliez | 10/11/88 |

Signed and Sealed this

Tenth Day of September, 1996

Bruce Lehman

*Attest:*

BRUCE LEHMAN

*Attesting Officer*

*Commissioner of Patents and Trademarks*